US008302823B2

(12) United States Patent
Lim

(10) Patent No.: US 8,302,823 B2
(45) Date of Patent: Nov. 6, 2012

(54) ANTI-LEAK DEVICE FOR TUBE CONTAINER

(75) Inventor: Jong Su Lim, Pocheon-si (KR)

(73) Assignee: Ipack Co., Ltd., Pocheon-Si (KR)

( * ) Notice: Subject to any disclaimer, the term of this patent is extended or adjusted under 35 U.S.C. 154(b) by 634 days.

(21) Appl. No.: 12/507,031

(22) Filed: Jul. 21, 2009

(65) Prior Publication Data

US 2010/0018971 A1 Jan. 28, 2010

(30) Foreign Application Priority Data

Jul. 23, 2008 (KR) ..... 10-2008-0071673

(51) Int. Cl.
*B65D 51/16* (2006.01)

(52) U.S. Cl. ..... 222/495; 222/92; 222/212

(58) Field of Classification Search ..... 222/495, 222/213, 212, 92, 494, 496, 497, 559; 220/203.19
See application file for complete search history.

(56) References Cited

U.S. PATENT DOCUMENTS 3,456,650 A * 7/1969 Schwartzman ..... 604/298
3,506,162 A * 4/1970 Schwartzman ..... 222/207
3,794,213 A * 2/1974 Schwartzman ..... 222/107
5,518,147 A * 5/1996 Peterson et al. ..... 222/153.07
5,862,955 A * 1/1999 Albini et al. ..... 222/212
6,854,623 B2 * 2/2005 Masuda ..... 222/212
6,968,976 B2 * 11/2005 Masuda ..... 222/92
7,059,501 B2 * 6/2006 Masuda ..... 222/494
7,140,517 B2 * 11/2006 Masuda ..... 222/213
7,249,694 B2 * 7/2007 Masuda ..... 222/212
7,500,585 B2 * 3/2009 Masuda ..... 222/494

FOREIGN PATENT DOCUMENTS

KR 20-0294624 10/2002

* cited by examiner

*Primary Examiner* — Kevin P Shaver
*Assistant Examiner* — Donnell Long
(74) *Attorney, Agent, or Firm* — Kile Park Goekjian Reed & McManus PLLC

(57) ABSTRACT

An anti-leak device for a tube container is disclosed, to have a predetermined amount of contents in the tube container be continuously extruded and then prevent more extrusion, and to prevent infiltration of external air. The anti-leak device includes a main body having a head with a tube outlets and a connection groove, and a leakage prevention unit having an opening and closing part, an insertion part and a fixed part. The opening and closing part is inserted in an inlet path of the insertion part. The insertion part is inserted in the fixed part having a discharge hole and engaged with the connection groove, thereby forming a movement space for the opening and closing part to reciprocate between the tube outlet and the insertion part. The opening and closing part directly opens and closes the tube outlet not to allow external air into the main body.

1 Claim, 5 Drawing Sheets

ANTI-LEAK DEVICE FOR TUBE CONTAINER

BACKGROUND OF THE INVENTION

1. Field of the Invention

The present invention relates to an anti-leak device for a tube container, and more particularly to an anti-leak device for a tube container capable of having a predetermined amount of contents in the tube container be continuously extruded and preventing more extrusion of the contents after extrusion of the predetermined amount by closing an outlet formed at a head of the tube container, and especially capable of fundamentally preventing infiltration of external air into the tube container.

2. Description of the Related Art

Generally, tube containers are used in a variety of fields. The tube container mainly comprises a main body storing contents injected therein and a head integrated with the main body. The head is formed with an outlet through which the contents in the main body are extruded and to which a cap is removably connected.

According to such a structure, as a user compresses the main body of the tube container, the contents are extruded through the outlet to be used. However, those general tube containers are inconvenient in that an unwanted large amount of the contents may be abruptly extruded when the user applies an excessive force by mistake and also in that the contents are continuously flown out through the outlet unless the cap closes the outlet right after the use. In addition, the contents may be deteriorated by infiltration of external air.

Korean Utility Model No. 294624 titled "Apparatus for preventing outflow of the contents from a tube receptacle" was filed by the present applicant and decided to maintain to suggest a solution to the inconveniences. The suggested related art will now be described in further detail with reference to the accompanying drawings.

Referring to the drawing, a tube container 1 comprises a main body 100 and a leakage prevention unit 200. The main body 100 is constituted by a head 110 formed at one end thereof and equipped with a tube outlet 112, and a connection groove 120. The leakage prevention unit 200 is constituted by an insertion part 210 including an inlet path 212 extended in one direction, an opening and closing part 220 disposed at the opposite side to the inlet path 212, forming a passage 222 corresponded to a leading end of the insertion part 210, and a fixed part 230 fixed to the connection groove 120 as receiving the insertion part 210 and the opening and closing part 220. The fixed part 230 comprises a movement space 232 in which the opening and closing part 220 operates, and a discharge hole 234.

The above-structured tube container 1 operates as follows. As the main body 100 is compressed, the contents injected in the main body 100 are passed through the tube outlet 112 of the head 110 and the inlet path 212, thereby pushing the opening and closing part 220 within the movement space 232. Accordingly, the opening and closing part 220 is moved to an opened position, thereby simultaneously letting the contents be extruded to the discharge hole 234 through the passage 222 formed at the opening and closing part 230 at the same time. After the main body 100 is released from the compression force, a suction force is generated due to a change of pressure difference of internal air of the main body 100 that has been compressed. The opening and closing part 220 pushed to the opened position in the movement space 232 is moved to block the inlet path 212 of the insertion part 210, accordingly preventing the contents from flowing out any longer.

However, since the leakage prevention unit 200 is inserted and fixed in the connection groove 120 of the head 110, external air may infiltrate into the contents in the main body 100 through a gap between an inner surface of the connection groove 120 and the fixed part 230 of the leakage prevention unit 200, thereby deteriorating the contents.

More specifically, the opening and closing part 220 of the leakage prevention unit 200 effectively prevents the contents from being extruded and flown out by operating in an opening and closing manner at one end of the inlet path 212 of the insertion part 210, that is, at the opposite side to the tube outlet 112. On the other hand, the fixed part 230 of the leakage prevention unit 200 inserted in the connection groove 120 formed at the head 110 has a gap with the inner surface of the connection groove 120, thereby allowing external air to directly flow into the main body 100 through the tube outlet 112.

Accordingly, the contents injected in the main body 100 are brought into contact with the external air flown through the gap between the fixed part 230 and the connection groove 120 and may be deteriorated in a short time.

SUMMARY OF THE INVENTION

Therefore, the present invention has been made in view of the above problems, and it is an object of the present invention to provide an anti-leak device for a tube container capable of having a predetermined amount of contents in the tube container be continuously extruded and preventing more extrusion of the contents after extrusion of the predetermined amount by closing an outlet formed at a head of the tube container, and especially capable of fundamentally preventing infiltration of external air into the tube container, the anti-leak device as an improved version based on KR Utility Model No. 294624 titled "Apparatus for preventing outflow of the contents from a tube receptacle" filed by the present applicant and decided to maintain.

It is another object of the present invention to provide an anti-leak device for a tube container having an opening and closing part stably operating and having an excellent airtightness.

In accordance with an aspect of the present invention, the above and other objects can be accomplished by the provision of an anti-leak device for a tube container, including a main body having a head disposed at an end thereof and formed with a tube outlet through which contents in the tube container are extruded by a compression force and a connection groove, and a leakage prevention unit connected to the connection groove formed at the head, including an opening and closing part, an insertion part and a fixed part to prevent leakage of the contents after extrusion of contents is completed, wherein one end of the opening and closing part is inserted in one end of an inlet path of the insertion part having drain grooves formed on an inner surface at predetermined intervals, the insertion part is inserted in one side of the fixed part having a discharge hole and engaged with the connection groove, thereby forming a movement space wherein the opening and closing part can be reciprocated between the tube outlet and the insertion part, and the opening and closing part directly opens and closes the tube outlet within the movement space so that external air is not allowed into the main body through the tube outlet.

The opening and closing part may include an opening and closing rib formed in the middle thereof to open and close the tube outlet, and the opening and closing rib includes supporting pins formed collinearly at each end of the opening and closing part with respect to the opening and closing rib, to be inserted in the tube outlet and in the insertion part, respectively.

Here, diameter of the opening and closing rib may be formed greater than diameter of the tube outlet but smaller than diameter of the movement space.

BRIEF DESCRIPTION OF THE DRAWINGS

The above and other objects, features of the present invention will be more clearly understood from the following detailed description taken in conjunction with the accompanying drawings, in which:

FIG. 3A shows the main parts in a state where contents of a tube container are extruded through a tube outlet in an opened state;

FIG. 3B shows the main parts in a state where the tube outlet is in a closed state.

DETAILED DESCRIPTION OF THE PREFERRED EMBODIMENTS

Hereinafter, an exemplary embodiment of the present invention will be described in detail with reference to the accompanying drawings.

Figure 1:
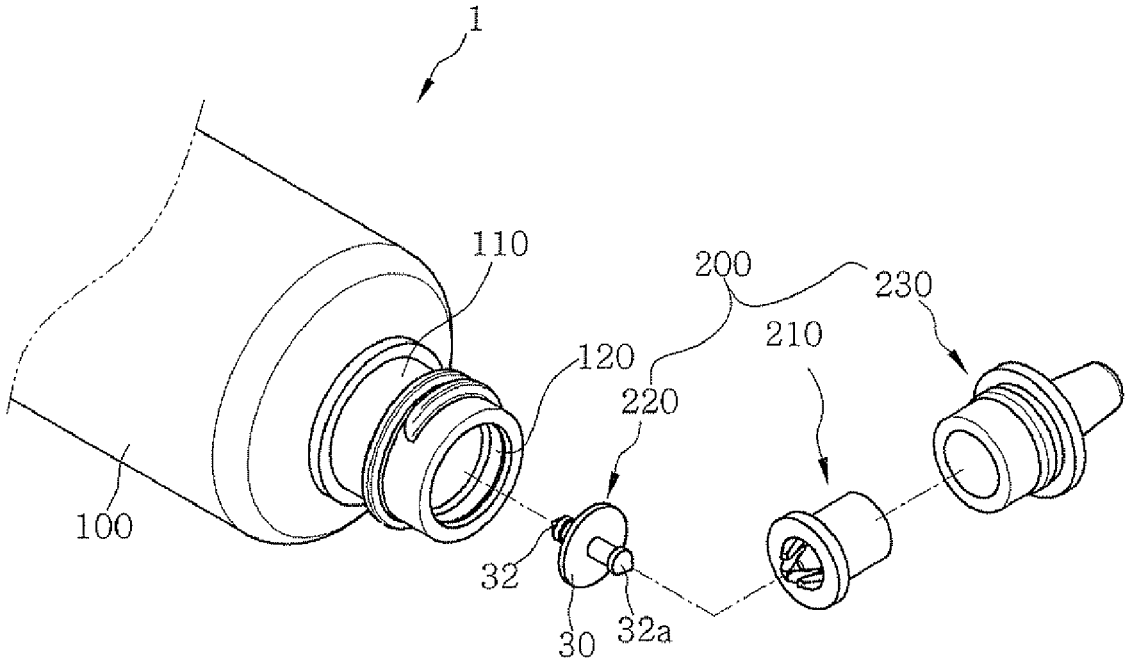
FIG. 1 is a perspective view showing the main parts of an anti-leak device according to an embodiment of the present invention.
Figure 2:
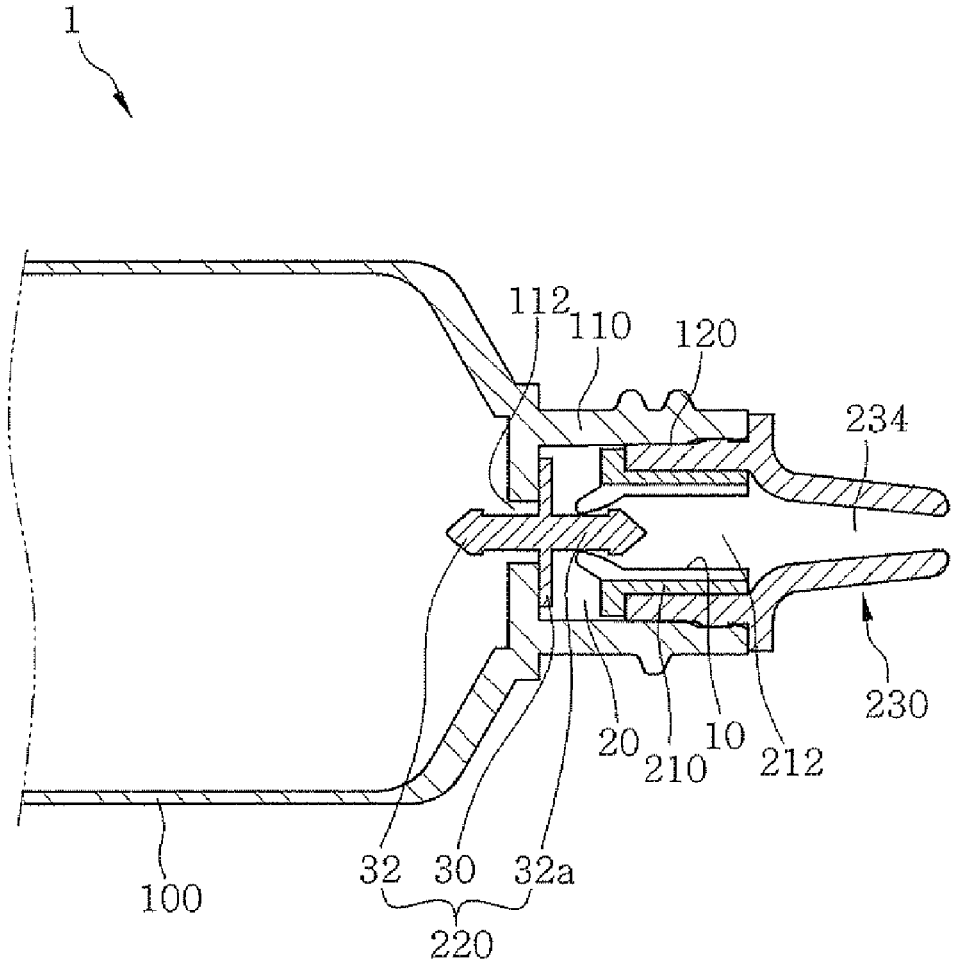
FIG. 2 is a sectional view of the main parts shown in FIG. 1.

FIG. 1 is a perspective view showing the main parts of an anti-leak device according to an embodiment of the present invention and FIG. 2 is a sectional view of the main parts shown in FIG. 1.

As shown in the drawings, a tube container 1 comprises a main body 100 and a leakage prevention unit 200. The main body 100 comprises a head 110 disposed at an end of the main body 100 and formed with a tube outlet 112 through which contents are extruded by a compression force, and a connection groove 120. The leakage prevention unit 200 is connected to the connection groove 120 of the head 110, including an opening and closing part 220, an insertion part 210 and a fixed part 230 to prevent leakage of the contents after the extrusion of contents is completed.

The tube container 1 having the leakage prevention unit 200 is structured to achieve the aspect of the present invention, that is, to have the contents of the tube container be continuously extruded by a predetermined amount while allowing no more extrusion after the predetermined amount of the contents are extruded by closing the tube outlet 112 formed at the head 110, and to fundamentally prevent infiltration of external air into the tube container.

To this end, more specifically, one end of the opening and closing part 220 is inserted in one end of the inlet path 212 of the insertion part 210 having drain grooves_10 formed on an inner surface at predetermined intervals. The insertion part 210 is inserted in one side of the fixed part 230 having the discharge hole 234 and engaged with the connection groove 120, thereby forming a movement space 20 wherein the opening and closing part 220 can be reciprocated between the tube outlet 112 and the insertion part 210. The opening and closing part 220 directly opens and closes the tube outlet 112 within the movement space 20 so that external air is not allowed to infiltrate into the main body 100 through the tube outlet 112.

The fixed part 230 is fixed by having a fixing recess formed on an outer surface thereof to be engaged with a locking protrusion formed at an end of the connection groove 120 of the head 110.

An opening and closing rib 30 is formed in the middle of the opening and closing part 220 to actually open and close the tube outlet 112. Supporting guide pins 32 and 32*a* are formed collinearly at each end of the opening and closing part 220 with respect to the opening and closing rib 30, to be inserted in the tube outlet 112 and in the insertion part 210, respectively. According to this, the opening and closing part 220 may be more stably open and close the tube outlet 112 by the supporting guide pins 32 and 32*a* inserted in the tube outlet 112 and the insertion part 210.

The opening and closing rib 30 has a greater diameter than the tube outlet 112 but a smaller diameter than the movement space 20. Therefore, the tube outlet 112 can be sealed with high airtightness by the opening and closing part 220 reciprocated within the movement space 20 whereas the contents can be smoothly extruded to the movement space 20 formed at the outer side of the opening and closing rib 30 by passing through the tube outlet 112.

Figure 3A:
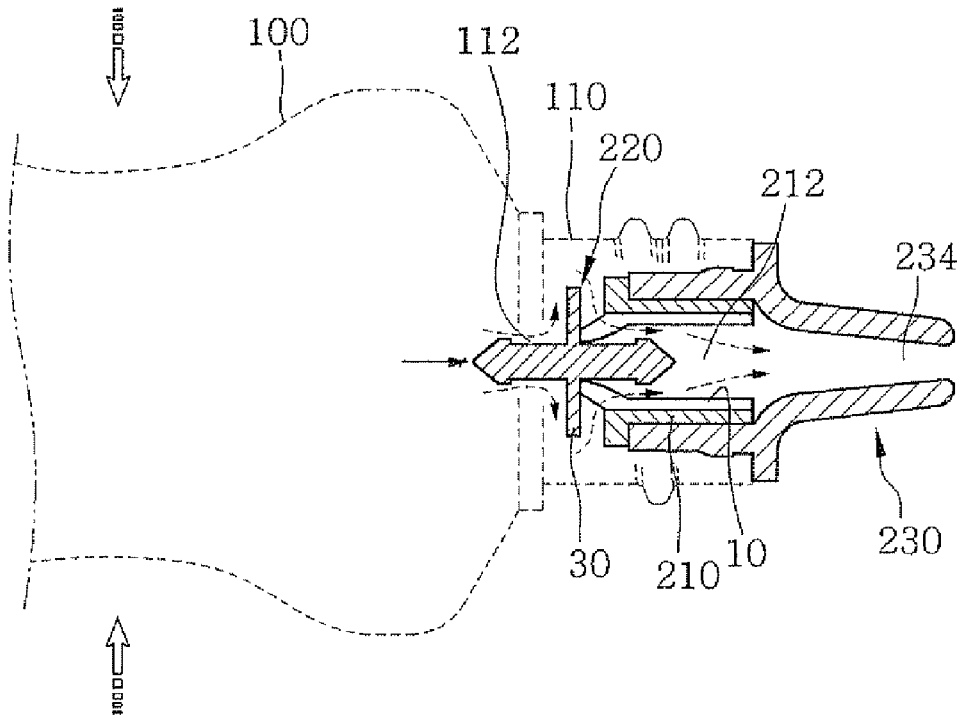
FIG. 3A and FIG. 3B are views schematically showing the used state of the anti-leak device, and more specifically.

According to the above explained structure, when the user compresses the main body 100 to extrude the contents from the inside of the main body 100 of the tube container 1, the contents are passed through the tube outlet 112 formed at the head 110, thereby pushing and opening the opening and closing part 220 closing the tube outlet 112 as shown in FIG. 3A. Simultaneously, the contents are extruded to the movement space 20 disposed at the outer side of the opening and closing rib 30. Next, the contents are passed through the drain grooves 10 formed on the inner surface of the insertion part 210, the inlet path 212, and the discharge hole 234 of the fixed part 320.

Thus, the contents in the main body 100 are extruded through the opening and closing 220, the insertion part 210 and the fixed part 230 of the leakage prevention unit 200 always by a fixed amount regardless of the user's compression force.

Figure 3B:
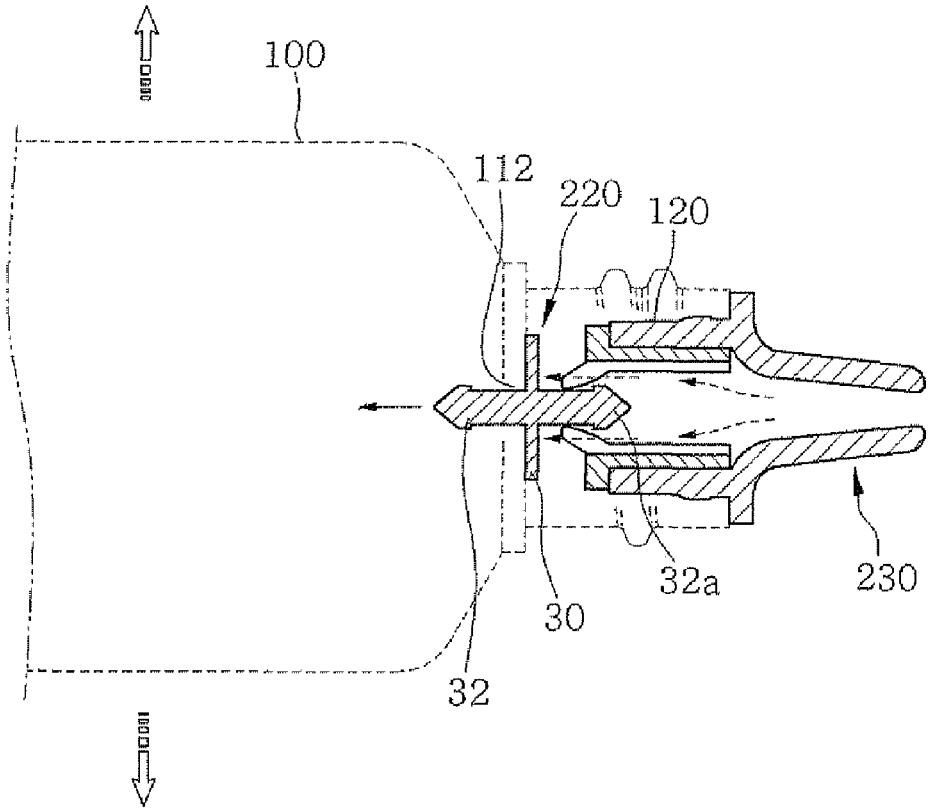
Figure 4:
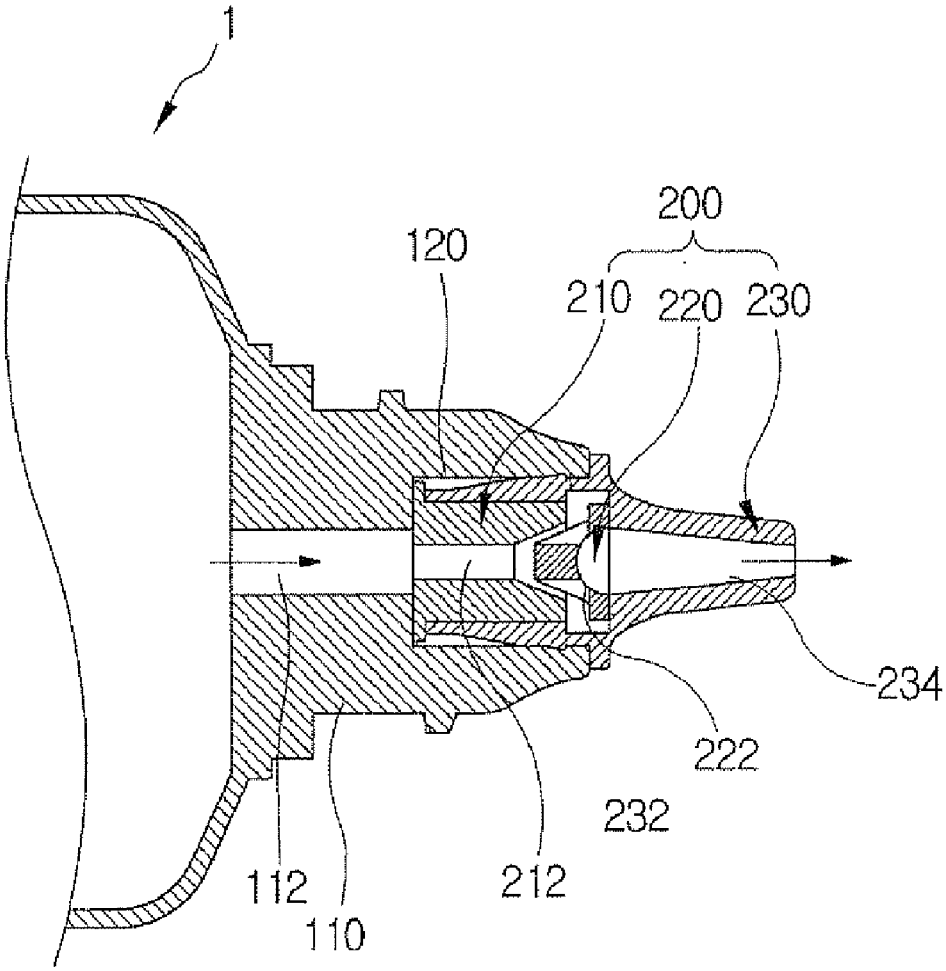
FIG.4 Prior Art
FIG. 4 is a sectional view of an apparatus for preventing outflow of the contents from a tube receptacle, according to a conventional art.

After extrusion of the contents to be used is completed, the compressed main body 100 is swollen back to the initial state as shown in FIG. 3B. Here, a suction force is generated due to the change of pressure in the main body 100, thereby pulling in the opening and closing part 220 that has been opening the tube outlet 112. As a result, the opening and closing 30 of the opening and closing part 220 closes the tube outlet 112, thereby preventing leakage of the contents.

In addition, the opening and closing part 220 is capable of opening and closing the tube outlet 112 more stably by the supporting guide pins 32 formed at both ends of the opening and closing part 220 and 32*a* inserted in the tube outlet 112 and the insertion part 210, respectively.

As described above, since the opening and closing part 220 is structured to directly open and close the tube outlet 112 of the head 110, although external air flows in through the gap between the fixed part 230 and the inner surface of the connection groove 120, infiltration of the external air into the main body 100 may be perfectly prevented because the tube outlet 112 is closed by opening and closing 220.

As a consequence, deterioration of the contents by the external air can be prevented, thereby elongating the usable period of the contents.

As apparent from the above description, the present invention provides an antileak device for a tube container, not only having a predetermined amount of contents in the tube container be continuously extruded but also preventing more extrusion of the contents after extrusion of the predetermined amount by closing an outlet formed at a head of the tube container, and furthermore fundamentally preventing infiltration of external air into the tube container. According to this, the contents in the tube container can be conveniently used by a desired amount and prevented from leaking after extruded by the desired amount. Furthermore, since infiltration of external air is prevented, the contents may be used for a longer time without deterioration.

In addition, supporting guide pins help stable operation of an opening and closing part that opens and closes the outlet. Therefore, malfunction of the opening and closing part may be reduced, thereby improving the reliability of the product.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An anti-leak device for a tube container, comprising:

a main body including a head disposed at an end thereof and formed with a tube outlet through which contents in the tube container are extruded by a compression force, and a connection groove; and a leakage prevention unit connected to the connection groove formed at the head, including an opening and closing part, an insertion part and a fixed part to prevent leakage of the contents after extrusion of contents is completed, wherein one end of the opening and closing part is inserted in one end of an inlet path of the insertion part having drain grooves formed on an inner surface at predetermined intervals, the insertion part is inserted in one side of the fixed part having a discharge hole and engaged with the connection groove, thereby forming a movement space wherein the opening and closing part can be reciprocated between the tube outlet and the insertion part, and the opening and closing part directly opens and closes the tube outlet within the movement space so that external air is not allowed into the main body through the tube outlet, wherein the opening and closing part comprises an opening and closing rib formed in the middle thereof to open and close the tube outlet, and the opening and closing rib includes supporting pins formed collinearly at each end of the opening and closing part with respect to the opening and closing rib, to be inserted in the tube outlet and in the insertion part, respectively, wherein diameter of the opening and closing rib is greater than diameter of the tube outlet but smaller than diameter of the movement space.

* * * * *